US006691776B2

(12) United States Patent
Guillory et al.

(10) Patent No.: US 6,691,776 B2
(45) Date of Patent: Feb. 17, 2004

(54) DOWNHOLE TOOL RETENTION APPARATUS

(75) Inventors: Brett W. Guillory, Woodlands, TX (US); John W. Tokar, Sherwood Park (CA)

(73) Assignee: Weatherford International, Inc., Houston, TX (US)

( * ) Notice: Subject to any disclaimer, the term of this patent is extended or adjusted under 35 U.S.C. 154(b) by 0 days.

(21) Appl. No.: 09/995,942

(22) Filed: Nov. 28, 2001

(65) Prior Publication Data

US 2003/0098155 A1 May 29, 2003

(51) Int. Cl.[7] ..... E21B 23/00
(52) U.S. Cl. ..... 166/187; 166/242.6
(58) Field of Search ..... 166/387, 187, 166/179, 181, 242.6

(56) References Cited

U.S. PATENT DOCUMENTS

| | | | | |
|---|---|---|---|---|
| 2,255,695 A | | 9/1941 | Bull | 287/119 |
| 5,109,925 A | * | 5/1992 | Stepp et al. | 166/184 |
| 5,143,015 A | * | 9/1992 | Lubitz et al. | 166/187 |
| 5,160,172 A | | 11/1992 | Gariepy | 285/18 |
| 5,692,564 A | * | 12/1997 | Brooks | 166/127 |
| 6,106,024 A | | 8/2000 | Herman et al. | 285/18 |
| 6,302,200 B1 | | 10/2001 | Patton et al. | 166/169 |

OTHER PUBLICATIONS

International Search Report mailed Apr. 4, 2003 for corresponding application PCT/GB02/05354.

* cited by examiner

*Primary Examiner*—William Neuder
(74) *Attorney, Agent, or Firm*—Howrey Simon Arnold & White, LLP

(57) ABSTRACT

Apparatus for attaching a downhole isolation, production, or testing tool is disclosed, such that the tool is mechanically attached to a mandrel in a manner that is highly resistant to axial movement. In general, the connection includes at least one groove or channel cut in an outer wall of the casing mandrel, and at least one partially or fully annular slot on the inside surface of the tool oriented to correspond with the groove(s) in the outer wall of the casing mandrel. At least one lock is situated in the corresponding slot and the groove. The lock engages the flanks of the slot and groove sufficiently to resist shear loads applied by compression or tension in the string. In one embodiment, the lock is one or more wires, although other mechanical locking devices may be installed to provide the same function.

13 Claims, 2 Drawing Sheets

Fig. 1
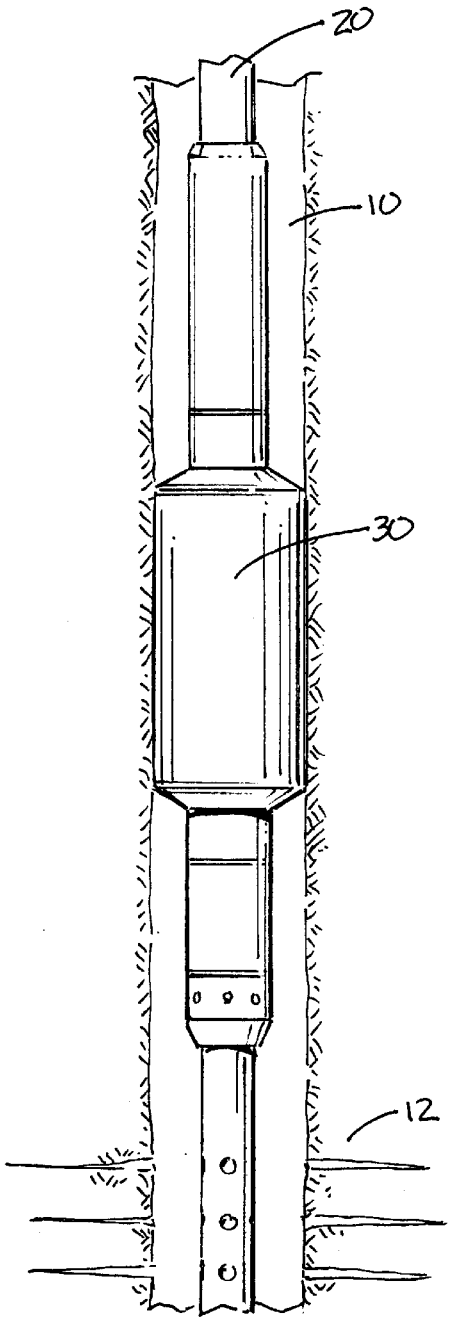
Fig. 3
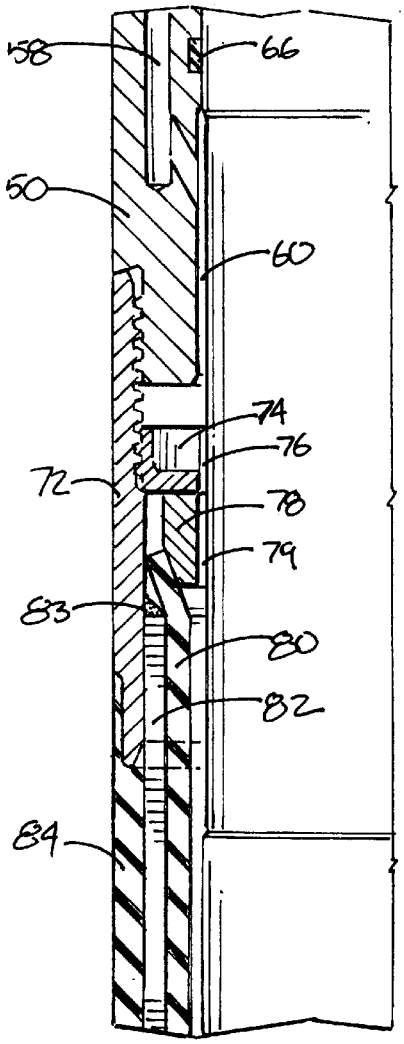
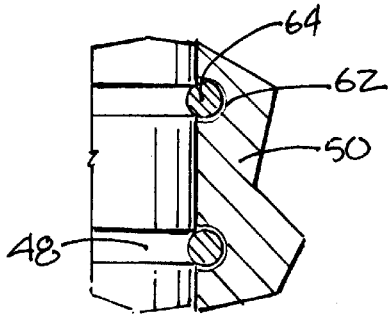
Fig. 4

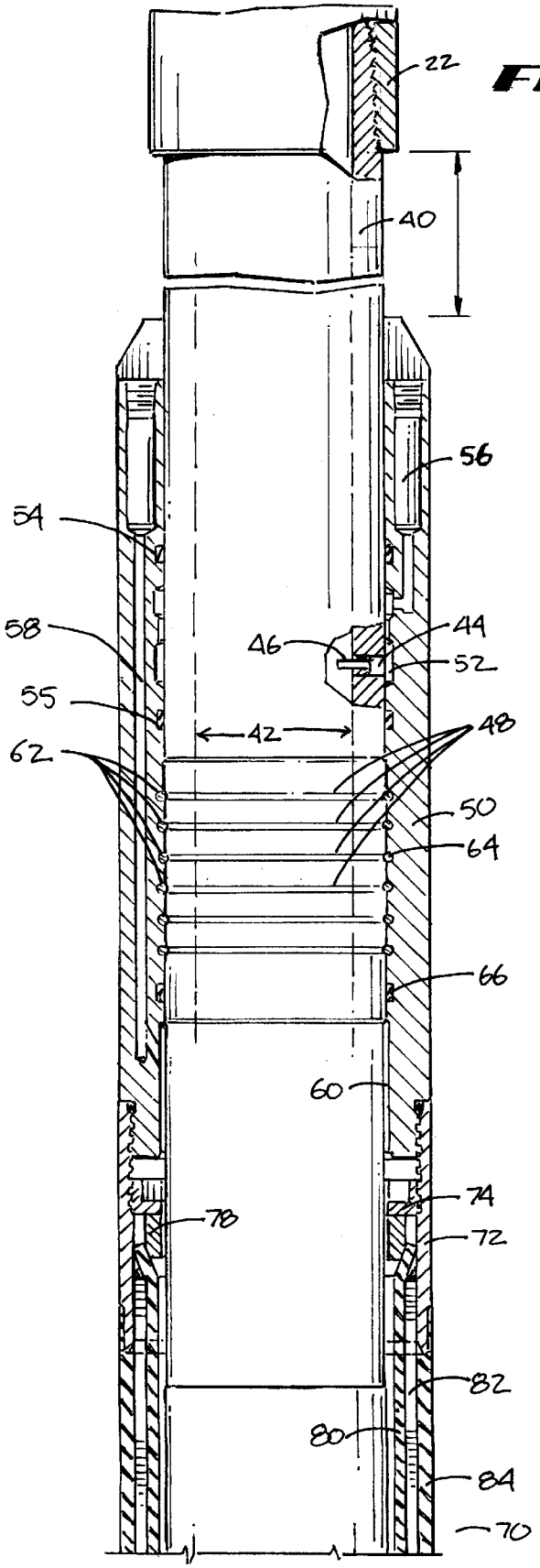
Fig. 2A
Fig. 2B
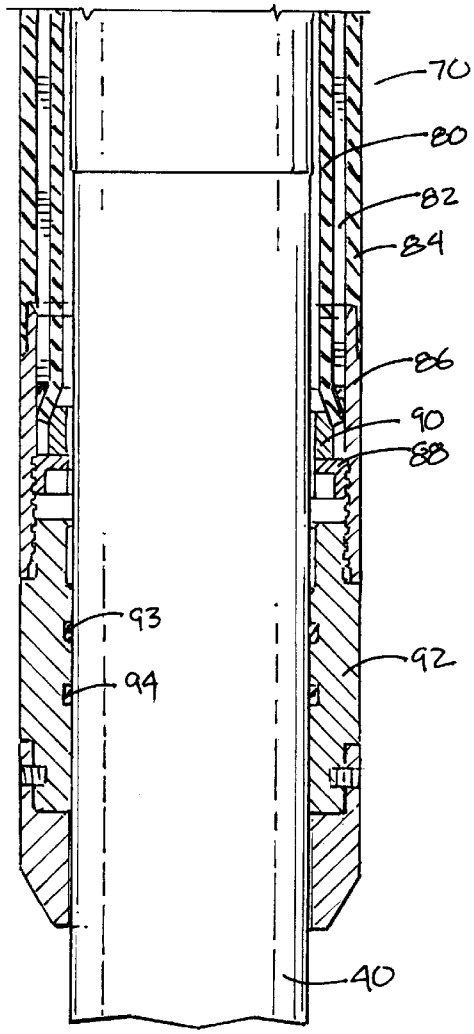

DOWNHOLE TOOL RETENTION APPARATUS

BACKGROUND OF THE INVENTION

This invention relates generally to well drilling or completion operations, and to the attachment of downhole isolation, production, or testing tools to casing or other work strings. In particular, the invention is directed to the attachment of isolation tools, such as an inflatable casing packer, or other production or testing tools, in a manner that reduces or eliminates welded connections.

In the oilfield industry, isolation, production, or testing tools are often attached to casing or other work strings in order to run the tool downhole into the wellbore. A casing string, or work string, is generally made up of a series of jointed steel pipe or tubing. The string is run into the wellbore with tools attached to perform one or more specific functions. The current invention relates primarily to the use of a tool known as a packer.

A packer is used to plug an area in a well by sealing off the annulus between the string on which the packer is run and the next outer casing (or the wellbore itself). Packers are well known in the art. One particular type of packer is an inflatable packer. Inflatable packers are run on the casing string, and inflated when the desired position in the well is reached, sealing the annulus at that particular location. Such inflatable packers, also called annulus casing packers, have a number of uses in well operations, including isolating producing zones, preventing gas migration, supporting or squeezing cement, or isolating liner hangers.

In general, inflatable casing annulus packers are made up of a casing mandrel, an inflatable element, and an inflation mechanism. The prior art annulus casing packers were commonly constructed such that the body of the tool was welded to the casing mandrel. Often multiple welds were employed, welding the casing to a sleeve disposed between the inflation mechanism and the coupling at the end of the tool, and welding the sleeve to the inflation mechanism. These welds add time and expense to the development of the tool. More importantly, welding can affect the metallurgy of the casing, making the welded area subject to attack, for example by corrosive well fluids. As such, welding to the casing or to coupling is at minimum undesirable, and may be prohibited under certain industry standard regulations.

Alternatively to the welded connection, it has been attempted to connect the inflation mechanism to the casing mandrel using adhesive or epoxy. However, the extreme conditions to which the tool is subject when run downhole into the portion of the wellbore that is of interest can include several thousand psi of pressure and/or temperatures over several hundred degrees Fahrenheit. Such conditions can have a detrimental effect on adhesion, potentially resulting in a failure of tool. As such, mechanical connections are preferable.

The ability to mechanically thread the casing mandrel to the inflation mechanism is limited by the need to maintain a minimum acceptable wall thickness, and inside diameter, in the casing mandrel. In general, for a five-inch nominal diameter casing the depth of a thread or groove in the casing mandrel should be no more than ½ of one percent of the inside diameter. This makes it difficult to create a threaded connection that is sufficient to resist the various tensile, compressive, and shear forces imposed on the fully loaded tool.

The disadvantages of welded, adhesive, and threaded connections in the coupling of the inflation assembly to the casing mandrel in an inflatable annulus casing packer to the casing mandrel are overcome by the present invention.

In addition, although the connection of the present invention is described with regard to its use with an inflatable packer, the invention is applicable to various other oilfield tools that are connected to casing or work strings for use in drilling, completion, production, or workover operations.

SUMMARY OF THE INVENTION

It is an aspect of the current invention that a tool, such as the inflatable annulus casing packer described in detail below or other isolation, production, or testing tool, may be attached to a mandrel in a manner that is highly resistant to axial movement. It is a further aspect of the invention that the mechanical connection is made using non-adhesive components combined in such a manner that they will resist the high temperatures, high pressures, and corrosive fluids and gases that may be encountered in the well.

In the embodiment described herein, the system of the present invention provides a high-strength non-welded mechanical connection between a casing mandrel and a valve assembly used to regulate hydraulic pressure and thereby inflate the inflatable element of a casing annulus packer. In general, the connection system includes at least one groove or channel cut in an outer wall of the casing mandrel. In preferred embodiments, the groove or channel is sufficiently shallow to avoid significantly thinning the wall thickness of the casing, and thereby ensures that compliance with industry standards is maintained.

The inside surface of the valve assembly, or other inflation mechanism, contains at least one partially or fully annular slot oriented to correspond with the groove(s) in the outer wall of the casing mandrel.

At least one lock is situated in the corresponding slot and the groove. The lock engages the flanks of the slot and groove sufficiently to resist shears loads applied by compression or tension in the string, and thereby restrains axial movement of the valve assembly relative to the casing mandrel. In a preferred embodiment, the lock is one or more wires, although other mechanical locking devices may be installed to provide the same function.

In a preferred embodiment, the system includes annular grooves in both the inner casing mandrel and the inflation mechanism or other tool. When multiple grooves are employed the grooves may be spaced apart, and a plurality of wires fed into the channels created by the corresponding pairs of grooves. In other embodiments there may be a single pair of aligned helical grooves, and a single wire or other lock installed.

In an embodiment of the invention, the wire or lock has relatively greater yield strength than the tool or the mandrel. As such, if the bearing surfaces of the connection begin to fail under shear, the yielded metal of the tool or the mandrel will be pushed axially, eventually bunching up and jamming the mechanism from further axial movement. As such, the current invention also provides a failure mode in which the inflation mechanism is rigidly fixed by the yielded metal, sealing the packer in its position and preventing failure of the inflatable portion.

It is another aspect of the current invention that the time to manufacture the tool, and the expenses involved, may be reduced by the novel form of attachment. In addition, welding between the valve element and the casing is eliminated, which reduces changes to the metallurgy of the tool, the invention reduces the number of areas particularly vulnerable to corrosive attack.

BRIEF DESCRIPTION OF THE DRAWINGS

FIG. 1 is a sectional elevation of a wellbore showing a casing string and an inflatable packer run in the well;

FIG. 2A is a partial sectional elevation of the up-stream portion of the inflatable packer;

FIG. 2B is a partial sectional elevation of the down-stream portion of the inflatable packer;

FIG. 3 is an enlarged partial section of the inflatable packer showing an interface between the casing mandrel, an inflatable element, and an inflation mechanism; and FIG. 4 is an enlarged partial section of one embodiment of the retention apparatus coupling the inflation mechanism to the casing mandrel.

DESCRIPTION OF ILLUSTRATIVE EMBODIMENTS

In FIG. 1 a casing or work string 20 is shown in a wellbore 10. The casing or work string is made up of a series of jointed steel pipe or tubing, and may contain one or more downhole tools. In FIG. 1, the casing string includes an inflatable packer 30. The inflatable packer is shown isolating a producing zone 12 in wellbore 10.

Although the use of the inventive tool retention apparatus is shown on an inflatable packer, the invention is not limited to use on this particular tool. The inventive concept of journaling a tool about a casing and using channels cut into the tool and casing with one or more wire locks, bearings, or other locking mechanisms to restrain axial movement is applicable to other forms of packers, such as compression set packers, as well as to other downhole isolation, production or testing tools. The inflatable packer shown in the accompanying figures is only one possible embodiment.

Referring now to FIGS. 2A and 2B, the inflatable annulus casing packer 30 is shown in partial sectional elevations. In other embodiments, packer 30 may be a compression set packer, or other tool similarly journalled about a casing mandrel 40. FIGS. 2A and 2B respectively represent upper and lower portions of the tool, but are not intended to be contiguous.

In FIG. 2A, a threaded coupling 22 connects the casing (not shown) to the casing mandrel 40 of the inflatable packer 30. Casing mandrel 40 is generally cylindrical and contains a generally cylindrical internal through bore 42. Bore 42 is co-extensive with the bore of the casing, allowing full diameter flow of fluids to or from the surface and into or out of the well, including the high pressure drilling fluids.

At least one port 44 extends through the side wall of the casing mandrel 40. Prior to inflating the element 70 of packer 30, the port 44 is closed to flow by a knock-off rod 46 that projects into the central bore 42 while the tool is being run. When the casing packer 30 is run to its desired position, a ball, dart, or other device is run down the string and shears the exposed portion of knock-off rod 46. This exposes the port 44 to the high pressure fluid in the string 20. The fluid is channeled from the port to a valve assembly, other inflation mechanism, or other setting element 50. In a compression set packer or other tool, the valve assembly could be a mechanical or hydraulically actuated setting element.

Assembly 50 is journaled about the outer wall of casing mandrel 40. A radial channel 52 is cut in the inner wall of the casing mandrel 40 to create an increased diameter portion that is aligned with flow port 44 to receive fluid flow. Seals 54 and 55 are located upstream and downstream of radial channel 52 to create a gallery and isolate fluid passage to the communication between flow port 44 and channel 52. Seals 54 and 55 may be O-ring seals or other types of seals commonly known.

Fluid flow from the radial channel 52, used to hydraulically actuate the inflatable packer, is controlled through one or more inflation valves 56. The valves 56 can be shear pinned at pre-determined pressures to activate at a specific differential pressure to prevent the valve from circulating high pressure fluid during run-in of the tool and prematurely inflating the packer, and to avoid pressure bleed off once the packer is fully inflated. Fluid from the outlet (offset and not shown) of the valves 56 passes through a port 58, generally parallel to the central bore 42, and is directed to the inflatable element 70.

It is a particular aspect of the current invention to restrict axial movement of the inflation mechanism 50 relative to the casing mandrel 40. As element 70 is inflated, outward force on the element 70 creates a draw force on the mechanism 50. If the inflation mechanism 50 is movable along the axis of the tool, the packer will be unable to develop sufficient sealing pressure against the annulus wall. For this reason, prior inflatable packers have generally welded the valve assembly 50 to the casing 20 or coupling 22. The present invention avoids this welding, or reduces the total number of welds.

In one embodiment of the current invention, as shown in FIG. 2A and FIG. 4, one or more grooves, or a series of radial grooves 48, is cut in the external wall of the casing mandrel 40. Grooves 48 need not be deeply cut into the outside diameter of the casing mandrel 40, and could be little more than indentations, aligned with a series of one or more corresponding annular grooves 62 in the inner wall of the valve assembly 50. Each annular groove 62 is connected to a lateral bore (not shown) between the groove and the external surface of the valve assembly 50.

With the valve assembly 50, or other inflation mechanism or setting element journaled about the casing mandrel 40, and the grooves 62 and 48 aligned, a wire or series of wires 64 can be disposed in the grooves 62 and 48. Wires 64 can be installed through the lateral bores, cut to appropriate lengths, and the opening of the lateral bores closed if desired.

Wires 64 bear on the flanks of grooves 62 and 48 to resist axial movement of the inflation mechanism 50 relative to the casing mandrel 40. In a preferred embodiment, the yield point of wires 64 will be greater than the yield point of the casing mandrel 40 and the valve assembly 50. For example, the steel of the casing mandrel 40 and valve assembly 50 may be typically 80 lb. yield. The wires 64 can be 250 lb. yield, without adding any appreciable expense to the device.

Because of the difference in the yield points, the metal of the casing mandrel 40 and valve assembly 50 will deform or fail due to shear forces before the wires 64. In the event of such a failure under shear, the yielded metal of the inflation mechanism 50 or the casing mandrel 40 will deform according to the axial forces, resulting eventually in the deformed metal bunching up and jamming the connection between the tool and the casing mandrel, and preventing further axial movement. As such, the current invention also provides a failure mode in which the inflation mechanism 50 is rigidly fixed by the yielded metal, sealing the packer 30 in its position and preventing failure of the inflatable portion 70.

In alternate embodiments, grooves 62 and 48 could be single helical grooves, and a single wire 64 could be threaded into the helical grooves. In addition, grooves 48 could be fully or partial channels, keyways, or other passageways. Wires 64 could be replaced by a series of ball bearings sized for the grooves, roller-type bearings, or wires or keys.

Seal 55, and an additional seal 66, are disposed above and below the grooves 48 and 62 and the wires 64 to prevent or reduce fluid infiltration into the grooves. Infiltration of fluid into the bearing area could induce separation of the casing mandrel 40 and the valve assembly 50, as well as lubricating the grooves 48 and 62, reducing the effectiveness of the retention apparatus.

Referring now to FIG. 2A and FIG. 3, the connection of the valve assembly or other inflation mechanism 50 and the element 70, both journaled around the casing mandrel 40, is shown. The connection allows the passage of hydraulic (or drilling) fluid through slots 74 in nut 76. The fluid is used to pressurize the space in inflatable element 70 between the casing mandrel 40 and rubber core 80.

Nut 76 is threaded to engage threads on the interior of end sleeve 72. The internal threads of end sleeve 72 also engage threads on the proximate end of valve mechanism 50.

A rubber core 80 is wrapped around the circumference of the casing mandrel 40 and is held tight to the end sleeve by a wedge 78 and both the wedge and the first end of the rubber core 80 are held in place by the threaded nut 74. A plurality of steel ribs 82 surround the rubber core 80, and have first ends held in place within the end sleeve 72. As shown in more detail in FIG. 3, the first ends of steel ribs 82 may have a welded connection 83 to the end sleeve 72. Ribs 82 may be continuous along the length of the tool, but need not be.

An outer rubber layer 84 may be installed to protect the steel ribs 82 and rubber core 80 from the annular surface that packer 30 is expanded against. Outer layer 84 also helps to protect the inflatable portion from the conditions in the well 10. In this respect, outer rubber layer 84 may be fused to the steel ribs 82 and to the end sleeve 72 (and the other end sleeve 86) prior to running the tool.

It should be noted that similar materials may be substituted for the rubber of rubber core 80 and outer layer 84, and for the steel of steel ribs 82. The purpose of these components and the particular materials is to allow the inflatable element to expand, yet maintain structural rigidity and resistance to the pressure and temperature conditions in the well. Any materials that accomplish such purposes could be substituted.

Referring now to FIG. 2B, the lower distal end of the rubber core 80 and steel ribs 82 are housed within a second end sleeve 86. A lock nut 88 and a wedge 90 are held by threaded connection between nut 88 and internal threads on end sleeve 86.

A seal housing 92 is threaded onto the second end sleeve 86 and extends axially from the end sleeve. Redundant seals 93 and 94 are disposed between the seal housing and the outer surface of the casing mandrel 40, substantially checking or preventing the passage of fluid and pressure.

In operation, the annulus casing packer 30 is run downhole on casing or work string 20. At the desired location, knock-off rod 46 is sheared, allowing high pressure fluid into port 58. Valves 56 control the flow through port 58 and into counterbore 60. The fluid passes through slots 76 and 79 in the nut 74 and wedge 78, and into the annular space between the rubber core 80 and the circumference of casing mandrel 40. However, further passage of fluid is checked by the seals 93 and 94 in the lower end sleeve. Increased pressure thus causes the rubber core 80 and the steel ribs 82 to expand outward from the casing mandrel 40 sealing off the annular space. It should be noted that any sliding movement of the inflation mechanism 50 relative to the casing mandrel 40 during or after the inflation of element 70 would result in decreased or no annulus sealing capability. Therefore, it is a feature of the invention that wire 64 in conjunction with grooves 48 and 62 restrain axial movement of the valve assembly relative to the casing mandrel 40.

The mechanical coupling discussed in detail above can be readily adapted to other isolation, production, or testing tools for downhole use. In such embodiments, a casing mandrel having a wall defining a lengthwise throughbore has at least one indent in the casing outer wall, at least one indent in an inner surface of the tool, and a lock at least partially located in the indent in the casing outer wall and at least partially in the indent in the inner surface of the tool to resist movement of the tool relative to the casing. The lock could be a wire, a mechanical key of any shape conducive to resisting the relative movement, bearings, or other mechanical components.

While the apparatus, compositions, and methods of this invention have been described in terms of preferred and illustrative embodiments, it will be apparent to those of skill in the art that variations may be applied without departing from the concept and scope of the invention. All such similar substitutes and modifications apparent to those skilled in the art are deemed to be within the scope and concept of the invention.

What is claimed is:

1. A mechanical coupling between a casing and an isolation, production, or testing tool installed on the casing, the coupling comprising:

at least one indent in the casing outer wall;

at least one indent in an inner surface of the tool; and a wire radially located in the indent in the casing outer wall and in the indent in the inner surface of the tool to resist movement of the tool relative to the casing.

2. A mechanical coupling between a casing and an isolation, production, or testing tool installed on the casing, the coupling comprising:

at least one semi-circular groove in the casing outer wall;

at least one semi-circular groove in an inner surface of the tool; and a plurality of bearings located at least partially in the groove in the casing outer wall and located at least partially in the groove in the inner surface of the tool to resist movement of the tool relative to the casing.

3. A tool assembly comprising:

a casing;

a casing mandrel coupled to the casing;

a valve assembly journaled on the casing mandrel;

a slot on an outer wall of the casing mandrel;

a groove, at least partially annular, on an inside surface of the valve assembly oriented with the slot;

at least one lock situated in the slot and the groove.

4. The tool assembly of claim 3 wherein the at least one lock comprises a plurality of bearings.

5. The tool assembly of claim 3 wherein the at least one lock comprises at least one mechanical key.

6. A tool assembly comprising:

a casing;

a casing mandrel coupled to the casing;

a valve assembly journaled on the casing mandrel;

a slot on an outer wall of the casing mandrel;

a groove, at least partially annular, on an inside surface of the valve assembly oriented with the slots;

at least one wire situated in the slot and the groove.

7. The tool assembly of claim 6 further comprising:

a packing element disposed on the casing mandrel and actuated by a fluid pressure asserted on the valve assembly.

8. The tool assembly of claim 6 wherein the at least one wire has a yield point greater than the yield point of the casing mandrel.

9. The tool assembly of claim 6 wherein there are a plurality of slots, and a plurality of grooves oriented with the slots.

10. The tool assembly of claim 6 wherein there is a single helical slot oriented with a single helical groove.

11. An inflatable packer comprising:

a mandrel;

an inflatable element journaled around the mandrel;

seals disposed between the mandrel and the element;

an inflation mechanism disposed on the mandrel and coupled to the inflatable element;

at least one retention groove between the mandrel and the inflatable element;

at least one locking element disposed in the retention groove.

12. An inflatable packer comprising;

a mandrel having a generally cylindrical wall defining an internal bore through the length of the mandrel;

a first flow port extending through the wall of the mandrel;

a valve apparatus installed about the mandrel, the valve apparatus having a flow passage aligned with the first flow port;

an element journaled about the mandrel, the element being expandable in response to increased pressure in the valve apparatus;

at least one set of corresponding grooves in an outer surface of the wall of the mandrel and an inner surface of the valve apparatus;

at least one wire situated in the at least one set of corresponding grooves.

13. A downhole packer comprising:

a mandrel;

a packing element disposed on the mandrel;

a setting element disposed on the mandrel;

at least one groove between the mandrel and the setting element;

at least one locking element disposed in the groove.

* * * * *